US009433808B2

(12) United States Patent
Curtis

(10) Patent No.: US 9,433,808 B2
(45) Date of Patent: Sep. 6, 2016

(54) NASAL FILTRATION SYSTEM

(75) Inventor: James Curtis, Dallas, TX (US)

(73) Assignee: IDEAS & INNOVATIONS, LLC, Carrollton, TX (US)

( * ) Notice: Subject to any disclaimer, the term of this patent is extended or adjusted under 35 U.S.C. 154(b) by 1325 days.

(21) Appl. No.: 12/880,879

(22) Filed: Sep. 13, 2010

(65) Prior Publication Data

US 2012/0060842 A1 Mar. 15, 2012

(51) Int. Cl.
*A62B 23/06* (2006.01)

(52) U.S. Cl.
CPC ..... *A62B 23/06* (2013.01)

(58) Field of Classification Search
CPC ..... A62B 23/06; A62B 23/00; A62B 23/02
USPC ..... 128/206.11
See application file for complete search history.

(56) References Cited

U.S. PATENT DOCUMENTS

| | | | | |
|---|---|---|---|---|
| 2,433,565 | A * | 12/1947 | Korman | 128/204.12 |
| 5,117,820 | A * | 6/1992 | Robitaille | 128/206.11 |
| 5,890,491 | A | 4/1999 | Rimkus | |
| 6,494,205 | B1 | 12/2002 | Brown | |
| 6,981,501 | B2 | 1/2006 | Michaels | |
| 7,156,098 | B2 | 1/2007 | Dolezal et al. | |
| 7,748,383 | B1 | 7/2010 | Soloway | |
| 2005/0051170 | A1* | 3/2005 | Koo | 128/206.11 |
| 2005/0061325 | A1 | 3/2005 | Michaels | |
| 2005/0066973 | A1 | 3/2005 | Michaels | |
| 2006/0096600 | A1* | 5/2006 | Witt et al. | 128/848 |
| 2006/0150979 | A1* | 7/2006 | Doshi et al. | 128/206.11 |
| 2008/0023007 | A1 | 1/2008 | Dolezal et al. | |
| 2009/0007919 | A1 | 1/2009 | Dolezal et al. | |
| 2009/0020125 | A1* | 1/2009 | Chang | 128/206.11 |
| 2009/0078263 | A1* | 3/2009 | Ozawa et al. | 128/206.12 |
| 2009/0101151 | A1* | 4/2009 | Russell | 128/206.17 |

FOREIGN PATENT DOCUMENTS

KR 20-0304089 Y1 2/2003

OTHER PUBLICATIONS

Webpage, "Toby's Nose Filters, Product Page"; http://www.nosefilters.com/prod01.htm.
"Does colloidal silver boost immunity or overall health?" The Healthy Skeptic.
"News Article written by Marvin Robey: A Safe and Simple Treatment for Alds".

* cited by examiner

*Primary Examiner* — Justine Yu
*Assistant Examiner* — Latoya M Louis
(74) *Attorney, Agent, or Firm* — David W. Carstens; Carstens & Cahoon, LLP

(57) ABSTRACT

A system for filtering breathing air and apparatus for accomplishing the same. The invention describes a nasal filtration system which can be inserted into the nasal cavities. The filters comprise cavities through which air is inhaled or exhaled. The filter performs as a mechanical filter to catch and prevent the inhalation of undesirable particulate. Further, the filter comprises a disinfectant agent, such as colloidal silver, which kills germs, bacteria, and viruses to prevent the spreading of disease.

17 Claims, 2 Drawing Sheets

NASAL FILTRATION SYSTEM

BACKGROUND OF THE INVENTION

1. Technical Field

The present invention relates to a system for filtering and treating air as it is inhaled through the nasal cavity.

2. Description of Related Art

Common colds and viruses are often spread through the air. Some diseases, such as the swine flu can spread rapidly from person to person. Diseases spread even faster when people are kept in a small space for an extended period of time. For example, on a train or plane passengers share a relatively tight space. Diseases flourish as the same air is circulated over time. As such when a passenger sneezes or coughs, the germs spread rapidly in the confined space.

As people have become more germ conscious they are seeking devices which would prevent the spread of diseases. One such device is the common face mask. The face mask covers the nose and mouth and offers a simple filter through which the breathing air must pass. There are several disadvantages to the face mask. First, masks do not always properly seal. As a result when the user inhales, some of the air bypasses the mask altogether. Second, the mask results in a build up of carbon monoxide within the mask which can cause minor issues for the users. Third, users who wear glasses often have the glasses "fog-up" due to the condensation caused by exhaling. Finally, the mask is not aesthetically pleasing. Many prefer not to wear the mask because it is not attractive. Moreover, in a group, a person wearing a mask is viewed as contagious or overly concerned with their health. As such, it is desirable to produce a filtration system which is discrete, effective, and which reduces any "fog-up" problems associated with the prior art.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures.

Figure 1:
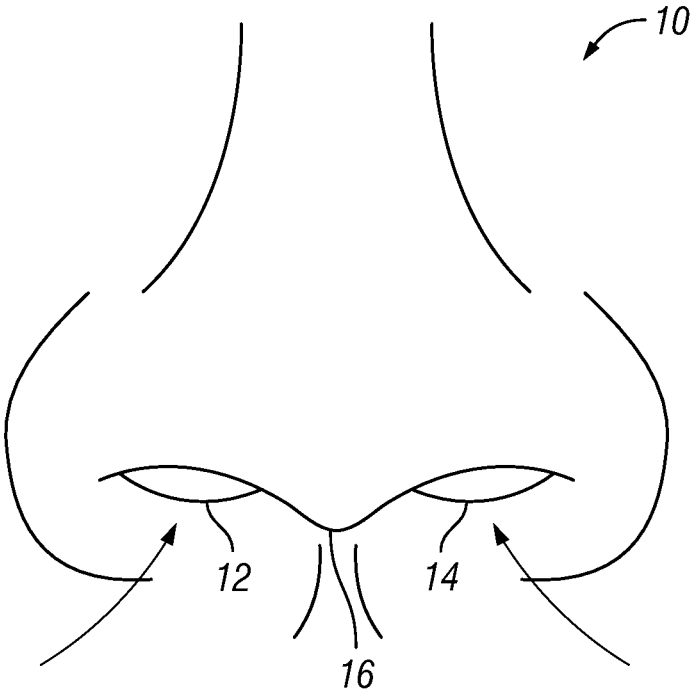
FIG. 1 is a front perspective view of a nose.

Generally, this invention relates to a filtration device used for filtering breathing air. Referring to FIG. 1, FIG. 1 is a front perspective view of a human nose. As can be seen the nose comprises a first left nasal cavity 12, a second right nasal cavity 14, and a septum 16. Air is withdrawn and expelled through the nasal cavities 12, 14.

Figure 2:
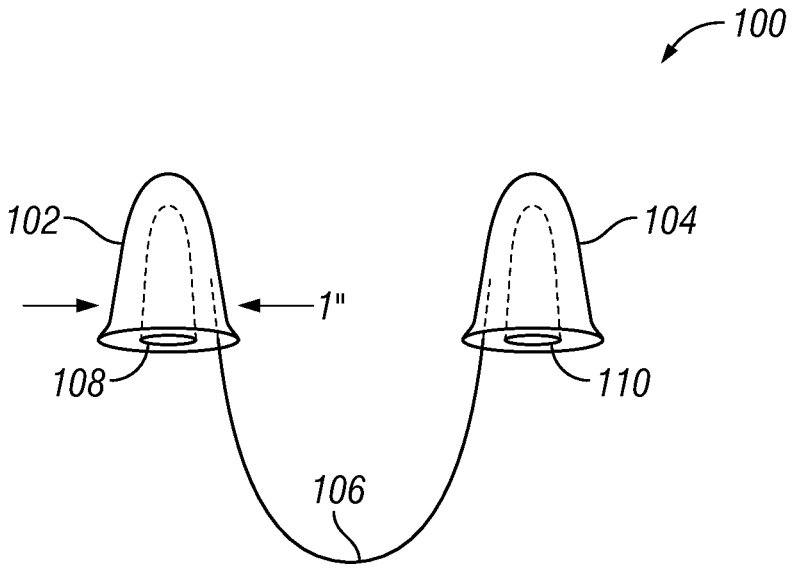
FIG. 2 is a front perspective view of the filtration device in one embodiment.

FIG. 2 is a front perspective view of the filtration device in one embodiment. The filtration device comprises a first filter 102, a second filter 104, and a bridge 106 which connects to the base of each filter. The filters 102, 104 are sized so as to fit snugly within the nasal cavities 12, 14. In one embodiment the first filter 102 is the same and operates the same as the second filter 104. Thus, while the first filter 102 will be described, the references will be applicable to the second filter 104 as well. In one embodiment the filters 102, 104 are about ½ to about 1 (one) inch in diameter in the uncompressed state. The filters 102, 104 are compressible so that they can obtain a compressed diameter that is approximately 30-80% of the uncompressed diameter. In another embodiment the filters 102, 104 are compressible so that they can obtain a compressed diameter that is less than 40%-60% of the uncompressed diameter. Of course, the amount of compressibility is linked to the density of the filter material and the size of the user's nasal cavities or nostrils.

In one embodiment the filters 102, 104 each include a first filter cavity 108, 110. The cavity is a void space in the filter. However, for certain materials, a cavity may not be needed. The size of the cavity 108, 110 relative to the filter 102, 104 is dependent upon a variety of factors including what particulate matter is desired to be filtered. In one embodiment the cavity comprises a diameter, or diameter equivalent of about ⅛ of an inch to about ⅜ of an inch. In one embodiment the filter 102 comprises only a single cavity 108, but in other embodiments the filter 102 comprises a plurality of cavities 108.

When installed in the nasal cavity 12, air is inhaled first through the cavity 108. Air then passes through the rest of the filter 102 and then downstream into the lungs. As used herein the terms upstream and downstream refer to a location of a process. The term upstream refers to an event or location which occurs prior to an event or location which is downstream.

In one embodiment the filters 102, 104 are generally conical in shape. Likewise the cavity 108, 110 is also conically shaped so that the thickness of the filter, as measured from the edge of the cavity 108 to the periphery of the filter 102, 104 is substantially constant. In another embodiment, the cavity 108 is elongated. The cavity 108 can comprise a length of about 1/16 of an inch to about ¾ of an inch. In one embodiment the cavity is about 50% to about 90% as long as the filters 102, 104. Because air is withdrawn through the filter cavity 108, increasing the surface area of the filter cavity 108 increases the surface area through which air can be inhaled or exhaled. If the filter cavity 108 was short compared to the length of the filters 102, 104, then the same volume of air would be required to travel through a limited amount of surface area. Thus, the filter cavity 108 would offer a relatively small amount of usable surface area. Usable surface area refers to the amount of surface area through which air can be inhaled or exhaled. In contrast, if the filter cavity 108 was long compared to the length of the filter, then the amount of usable surface area is increased. Likewise, if a filter 102, 104 comprises multiple filter cavities 108, then the amount of usable surface area is further increased. Increasing the amount of usable surface area makes it easier to inhale or exhale.

In one embodiment the cavity 108 is sized and shaped so as to maximize usable surface area. In one embodiment the cavity 108 has non-linear boundaries which separate the cavity 108 from the filter 102. For example, in one embodiment the cavity 108 comprises jagged edges which offer more surface area than a straight edge. As those skilled in the art will understand, the size of the cavity 108 is often dependent on the material of the filter 102. If the filter 102 comprises dense material, then the cavity 108 could be generally larger to allow for easier inhaling and exhaling.

The cavity 108 can comprise a simple void in the material. Put differently, in one embodiment there is not a membrane layer between the cavity 108 and the rest of the filter 102. In other embodiments, however, the filter 102 comprises a membrane layer on the periphery of the cavity 108. Such a layer offers support to the filter 102 and prevents the filter 102 from caving onto or restricting the cavity 108. The membrane layer can surround the entire external surface of the cavity 108, or it can be placed in certain locations to structurally reinforce the cavity 108. Those skilled in the art will understand when and how to implement the membrane layer.

In some embodiments the filters 102, 104 comprise an external membrane covering the outer surface of the filter 102, 104. In one embodiment the membrane comprises a thickness of about ⅛ of a millimeter to about 2 millimeters. In one embodiment the membrane comprises a thickness of about ¼ of a millimeter to about 1 millimeter. The external membrane can comprise a material which increases the comfort of the device or improves its hypoallergenic properties. The external membrane may be a dissimilar material than the rest of the filter 102. Thus, the filter 102 may comprise one material while the external membrane comprises a dissimilar material. In one embodiment, the external membrane increases the structural rigidity of the device.

The external membrane may cover the entire outer surface of the filter 102 or may only cover a portion, such as the sides. In one embodiment, the external membrane comprises an air permeable material.

The filter 102 can be made of a variety of materials including cotton, nylon, polyethylene, polypropylene, memory foam, and hypoallergenic materials such as PCV or polyurethane. Those skilled in the art will be able to determine which material is suitable for a given embodiment. The density of the material should be thin enough to allow the user to easily inhale and exhale through the filter yet thick enough to trap the unwanted particulates. Thus, the filter 102 should comprise air permeable materials.

In one embodiment the filter 102 comprises a memory foam. A memory foam refers to a breathable material which comprises a pre-set shape. Such foams may be compressed to a smaller shape and then later expanded to the larger, pre-set configuration, namely, the internal shape of the users nostril. The density of the foams can be adjusted to a desired density. The foams can be formed of a variety of materials as discussed above and known in the art.

The memory foam provides a variety of benefits. One benefit is that the density of the foam can be adjusted during manufacturing. Monitoring the density ensures that inhaling an exhaling is not undesirably restricted. Another benefit is that the foam is compressible. Accordingly, the filter 102 can be slightly compressed prior to being installed into the nasal cavity. Thereafter, the filter 102 can expand to fill the nasal cavity. In one embodiment the filter 102 is sized so that the filter occupies greater than about 80% of the surface area of the nasal cavity entrance after expansion of the filter 102. In another embodiment the filter is sized to occupy greater than about 90% of the surface area of the nasal cavity entrance after expansion. This reduces the amount of air which can bypass the filter, reducing the effectiveness of the filter. When the filter 102 expands in place it becomes secure due to friction and expansion forces. This prevents movement of the filter 102.

The filter 102 acts as a mechanical filter by catching undesirable particulate and preventing them from passing. Undesirable particulates such as pollen, dust, and some bacterial and viruses, depending on the size, can be caught in the filter 102. In one embodiment the filter 102 further comprises a disinfectant agent. A disinfectant agent as used herein refers to a substance that destroys microorganisms and includes anti-microbial agents. In one embodiment, the disinfectant agent comprises an antibiotic. Those skilled in the art will know which disinfectant agents can be safely employed to attack specific microbes, viruses, etc. Different disinfectant agents may be selected to destroy different microbes. One filter may comprise a variety of disinfectant agents. Because the filter is placed in the nasal cavity, any disinfectant agent must not be toxic at levels utilized. In one embodiment the disinfectant agent comprises colloidal silver. In one embodiment the disinfectant agent comprises MicroBan made by MicroBan International, Ltd. of Huntersvile, N.C., USA. In one embodiment the disinfectant agent is used in an effective dosage. As effective dosage is the amount necessary to reach the desired amount of protection. In one embodiment an effective dosage is a dosage which results in greater than 50% of the virus, bacteria, and/or germs being killed. In another embodiment an effective dosage is a dosage which results in greater than 99% of the virus, bacterial, and/or germs being killed.

Figure 3A:
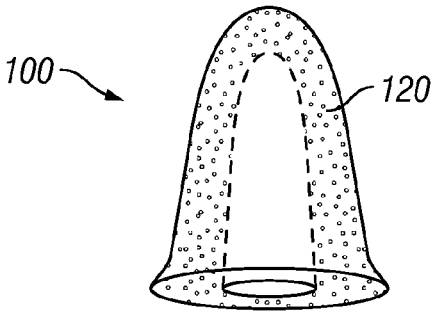
FIGS. 3A-B are cut-away views of the filtration device in one embodiment.
Figure 3B:
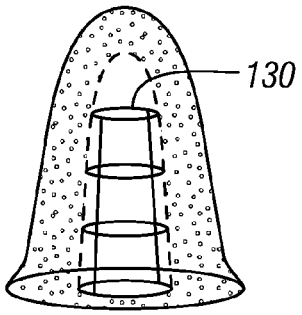

FIGS. 3*a-b* are top perspective cut-away views of the filtration device in one embodiment utilizing a disinfectant agent 120. As depicted, the filter 102 is impregnated with a disinfectant agent 120. The disinfectant agent 120 can comprise distinct segments as shown in FIG. 3 or the agent can be homogenously mixed throughout the filter. FIG. 3*b* depicts an embodiment comprising an interior frame 130 which prevents the filter from being completely closed. The interior filter frame can comprise many materials known in the art. In one embodiment the filter frame adds structural rigidity to the filter. In one embodiment the filter frame is skeletal so as to maximize the surface contact between the filter cavity and the disinfectant agent.

As discussed, in one embodiment the disinfectant agent comprises colloidal silver. Colloidal silver is known to kills germs, viruses, and bacterial. When employed in the filter 102, the colloidal silver, or other disinfectant agent, kills unwanted germs being inhaled through the filter. In one embodiment the filter 102, 104 kills greater than 50% of germs, while in other embodiment the filter 102, 104 kills greater than 99% of germs. In one embodiment the filter 102, 104 kills greater than 50% of germs, viruses and bacteria that enter the filter 102, 104 In another embodiment the filter 102, 104 kills greater than 99% of the germs, viruses and bacteria that enter the filter 102, 104. As the air passes through the filter 102, 104 the filter 102, 104 mechanically restricts larger undesired particulates. Likewise, the colloidal silver, or other disinfectant agent, kills or destroys smaller particles before they are fully inhaled. As such the disinfectant agent provides another opportunity to prevent the inhalation of bacteria, viruses, pollen, etc. Thus, the spreading of disease is decreased compared to a simple mechanical filter, such as the common air mask. In one embodiment an effective dosage of colloidal silver is utilized in the filter 102, 104.

Referring back to FIG. 2, the filter 102, 104 comprises a base and a top. In one embodiment the filter 102, 104 comprises a conical shape so that the base is wider than the top. This shape allows the filter to restrict an optimal amount of inhaled air while still fitting within the nasal cavity. The filter 102, 104 can comprise a variety of cross-sectional shapes including circular, oval, and square. Different shapes are suitable for different noses. The filters 102, 104 can comprise any suitable length. In one embodiment the filters 102, 104 comprise a length so that they can fit snugly within the nasal cavity. In one embodiment the filters 102, 104 comprise a length from about ¼ of an inch to about 2 inches. In one embodiment the filters 102, 104 comprise a length of about ¼ of an inch to about 1 inch.

As seen in FIG. 2, the two filters 102, 104 are connected by a bridge 106. The bridge 106 can be soft and bendable or it can be rigid. In one embodiment the bridge offers either compression or expansion forces upon the filters 102, 104. For example, in one embodiment the bridge 106 comprises a memory material such as a spring or bent rod. When the filters 102, 104 are inserted into their respective nasal cavities 12, 14, the filters 102, 104 may have to be pressed together or pressed apart to fit in the cavities 12, 14. If the filters 102, 104 must be pressed together in an inward direction, the bridge 106 may offer an outward force when the filters are inserted in the nose. Such an outward force maintains the filters 103, 104 in their installed position. Likewise, if the filters 102, 104 must be pulled apart in an outward direction before insertion, the bridge 106 may offer an inward force when the filters are inserted. In still other embodiments, the bridge 106 does not offer either an inward or an outward force.

The bridge can be made of any material previously discussed. Further, the bridge may comprise rigid materials such as metal or wood. In one embodiment the bridge 106 is transparent. The bridge 106 can comprise a variety of shapes. FIG. 2 shows an embodiment wherein the bridge comprises a loop shape. The bridge 106 can be sized to be snugly against the septum or be spaced apart from the septum. The bridge 106 allows insertion and removal of the filtering device. Further, the bridge 106 prevents the filters from being inserted too far within the nasal cavity.

Figure 4A:
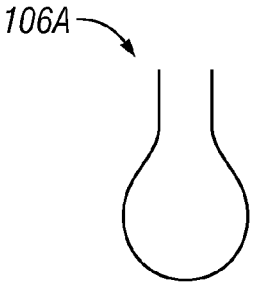
FIGS. 4A-4C are a top planar view of the various bridge embodiments.
Figure 4B:
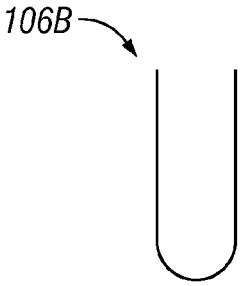
Figure 4C:
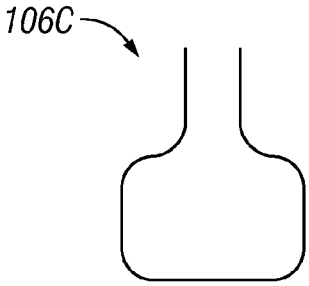

FIGS. 4*a*-4*c* are a top planar view of other various bridge embodiments. FIG. 4*a* shows a circular loop. FIG. 4*b* shows a steep bridge shape. FIG. 4*c* shows a wide bridge shape. As can be seen, the bridge 106 can be shaped to accommodate septums of varying sizes and shapes. The bridge 106 can comprise a variety of lengths. In one embodiment the bridge 106 comprises a length of about ⅛ of an inch to about one half inch. In another embodiment the bridge 106 comprises a length of about ¼ of an inch to about ⅜ of an inch.

Figure 5:
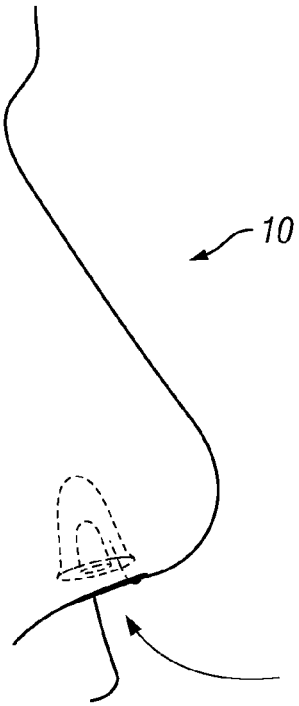
FIG. 5 is a top perspective view of the installed filtration device.

FIG. 5 is a side view of the installed filtration device. As can be seen the device is inserted so that it is recessed within the nasal cavity. In one embodiment the base of the device is inserted from about 1/16 of an inch to about ¼ of an inch into the nasal cavity. To install the device the user simply presses upon either the individual filters to compress them to a size smaller than the nostril diameters, inserts the fillers and allows them to expand to fill against the interior walls of the nostrils. To remove the filters the user grabs the bridge and pulls downward.

While the invention has been particularly shown and described with reference to a preferred embodiment, it will be understood by those skilled in the art that various changes in form and detail may be made therein without departing from the spirit and scope of the invention.

What is claimed is:

1. A breathing air filtration device comprising:

a first non-rigid filter of memory foam comprising a cavity, a second non-rigid filter of memory foam comprising a cavity, a bridge connected to said first and second filter, wherein said first and second filters include a disinfectant agent.

2. The filtration device of claim 1 wherein said first and second filters comprise a base, and wherein said cavity for said first and second filter extends to the base of said first and second filters.

3. The filtration device of claim 1 wherein said first and second filters further comprise a membrane layer.

4. The filtration device of claim 3 wherein said membrane layer covers the entire periphery of said cavity of said first and second filter.

5. The filtration device of claim 1 wherein said disinfectant agent comprises colloidal silver.

6. The filtration device of claim 1 wherein said first and second filters comprise a conical shape.

7. The filtration device of claim 1 wherein said first and second filters comprise an external membrane.

8. The filtration device of claim 7 wherein said external membrane covers an external surface of said first and second filter.

9. The filtration device of claim 1 wherein said cavity of said first and second filters comprise a conical shape.

10. The filtration device of claim 1 wherein said bridge is rigid.

11. The filtration device of claim 1 wherein said bridge is transparent.

12. The filtration device of claim 1 wherein said first and second filter is expandable.

13. The filtration device of claim 1 wherein said first and second filters are air permeable.

14. The filtration device of claim 1 wherein said first and second filters are sized to fit within a nasal cavity.

15. The filtration device of claim 1 wherein said cavities of said first and second filters comprise non-linear edges.

16. The filtration device of claim 1 wherein said disinfectant agent comprises MicroBan.

17. The filtration device of claim 1 further comprising a filter frame.

* * * * *